US006099352A

United States Patent [19]

Yamaguchi

[11] Patent Number: 6,099,352

[45] Date of Patent: Aug. 8, 2000

[54] SHIELDED CONNECTOR

[75] Inventor: Noboru Yamaguchi, Shizuoka, Japan

[73] Assignee: Yazaki Corporation, Tokyo, Japan

[21] Appl. No.: 09/161,441

[22] Filed: Sep. 28, 1998

[30] Foreign Application Priority Data

Sep. 29, 1997 [JP] Japan ..... 9-264219

[51] Int. Cl.[7] ..... H01R 9/03

[52] U.S. Cl. ..... 439/610

[58] Field of Search ..... 439/607–610

[56] References Cited

U.S. PATENT DOCUMENTS

| | | | |
|---|---|---|---|
| 4,449,778 | 5/1984 | Lane | 439/610 |
| 5,222,909 | 6/1993 | Nomura et al. | 439/610 |
| 5,415,568 | 5/1995 | Kinoshita | 439/610 |
| 5,421,744 | 6/1995 | Hio | 439/610 |
| 5,791,939 | 8/1998 | Tanigawa | 439/610 |

FOREIGN PATENT DOCUMENTS 5-27978 4/1993 Japan .

*Primary Examiner*—Hien Vu

*Attorney, Agent, or Firm*—Armstrong, Westerman Hattori, McLeland & Naughton

[57] ABSTRACT

A shielded connector with simple structure and with high reliability in grounding is provided, which includes: a connector housing having a terminal accommodating chamber and an engaging hole to receive a conductive metal bracket; and a shielded terminal, to be accommodated in the terminal accommodating chamber, having a grounding plate to be inserted into the engaging hole. The engaging hole receives and locks the conductive metal bracket fixed to an attaching member. The grounding plate is formed integrally with an outer terminal of the shielded terminal through a connecting portion and electrically connected to the conductive metal bracket upon insertion of the conductive metal bracket into the engaging hole. Thus, the aforementioned shielded connector can be realized.

6 Claims, 4 Drawing Sheets

SHIELDED CONNECTOR

BACKGROUND OF THE INVENTION

1. Field of the Invention

The present invention generally relates to structure of a connector and more particularly, to a shielded connector which accommodates a shielded terminal and is fixed to an attaching member through a conductive metal bracket.

2. Related Art

Structure of a shielded connector fixed to an attaching member through a conductive metal bracket is disclosed in Japanese Utility Model Registration Application Laid-open No. Hei 5-27978 (hereinafter "JUM '978").

The shielded connector disclosed in JUM '978 has following structure. A conductive supporting bracket is fixed to a conductive attaching member. A terminal-unit mounting hole-portion for accommodating a shielded terminal, a grounding terminal engaging recess for receiving a grounding terminal, and a leg insertion hole for receiving a leg of the grounding terminal to be put into contact with an outer terminal of the shielded terminal are provided on a connector housing to be attached to the supporting bracket. And, the supporting bracket is provided with a grounding plate to be put into contact with the grounding terminal.

With respect to the above conventional shielded connector of JUM '978, however, structure of the connector housing and the supporting bracket is complicated, which brings a high cost, and uncertain grounding would arise because of a lot of contact points on grounding conductor.

SUMMARY OF THE INVENTION

In view of the foregoing, an object of the present invention is to provide a shielded connector with a simple connector housing and therefore with the low cost, while reducing number of contact point on grounding conductor for enhancing reliability in the grounding.

In order to achieve the above object, the present invention provides a shielded connector including: a connector housing having a terminal accommodating chamber and an engaging hole into which a conductive metal bracket fixed to an attaching member is inserted and locked; a shielded terminal, to be accommodated in the terminal accommodating chamber, having an inner terminal, an insulating member covering the inner terminal, and an outer terminal covering the insulating member; a grounding plate connected to the outer terminal and put into electrical-contact with the metal bracket upon insertion of the metal bracket into the engaging hole so as to ground the outer terminal; and whereby structure of the connector housing is simplified and reliability in grounding is enhanced.

The above shielded connector may include a connecting portion which integrally connects the outer terminal and the grounding plate.

And, in the above structure, a front end of the grounding plate may be inserted into the engaging hole when the outer terminal is inserted into the terminal accommodating chamber.

Further, the shielded connector may include a projection provided on the grounding plate and put into pressure-contact with the metal bracket inserted into the engaging hole.

Still further, the connecting portion may have a length corresponding to number of the outer terminal and is arranged on a wire connecting side of the outer terminal.

According to the present invention as described hereinabove, since the grounding plate to be put into contact with the conductive metal bracket fixed to the conductive attaching member is formed integrally with the outer terminal of the shielded terminal, a grounding terminal conventionally provided on a connector housing can be eliminated so as to simplify structure of a connector housing and its assembly work, thereby reducing the cost of the connector.

Further, since the shielded terminal is directly electrically connected to the metal bracket, number of contact point on grounding conductor can be reduced, thereby ensuring the grounding.

Still further, since movement of the grounding plate formed integrally with the shielded terminal is restricted by the metal bracket, movement of the shielded terminal is correctly restricted in the connector housing.

The above and other objects and features of the present invention will be more apparent from the following description taken in conjunction with the accompanying drawing figures.

BRIEF DESCRIPTION OF THE DRAWING FIGURES

DETAILED DESCRIPTION OF THE PREFERRED EMBODIMENT(S)

Embodiment of the present invention will now be described in further detail with reference to the accompanying drawing figures.

FIGS. 1–6 show an embodiment of a shielded connector in accordance with the present invention.

Figure 1:
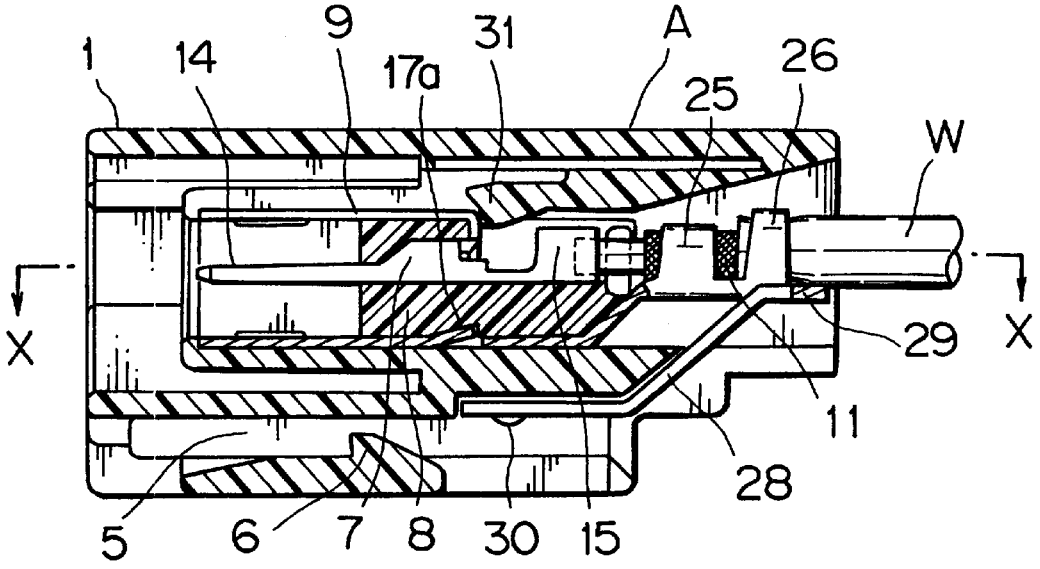
FIG. 1 is a longitudinal sectional view showing an embodiment of a shielded connector in accordance with the present invention.
Figure 2:
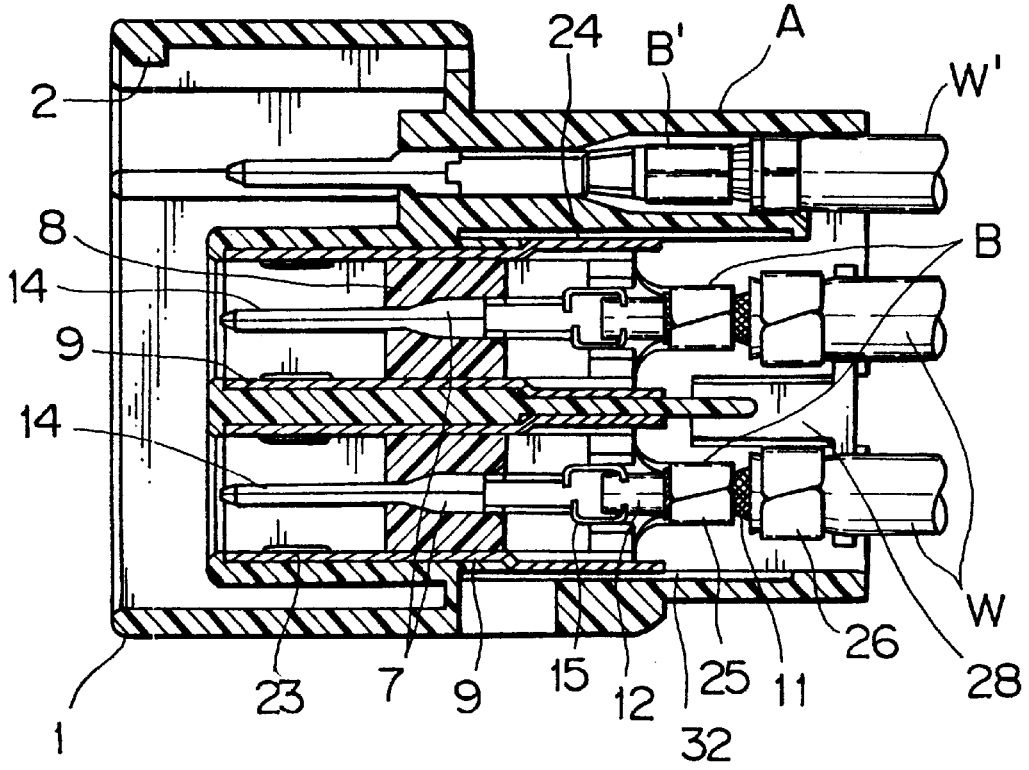
FIG. 2 is also a longitudinal sectional view taken along a line X—X in FIG.1.

Referring to FIGS. 1 and 2, a connector housing A is a female one made by integrally molding insulative synthetic resin and is provided, on a left side portion, with a hood 1 to receive a mating male connector housing. The hood 1 is provided with an engaging projection 2 on an inner wall surface thereof to engage the mating male connector housing.

Figure 3:
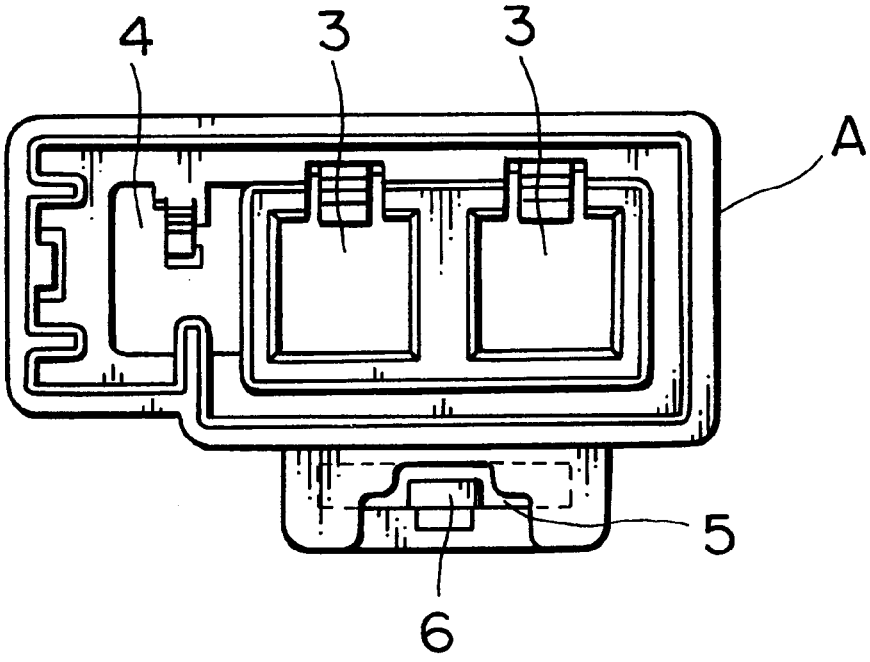
FIG. 3 is a front view of FIG. 1.

Referring to FIGS. 2 and 3, two terminal accommodating chambers 3 and another terminal accommodating chamber 4 are provided in the connector housing A, and a shielded terminal B and another terminal B' are inserted into the terminal accommodating chambers 3 and 4, respectively.

An engaging hole 5 lying under the terminal accommodating chambers 3 in a back and forth direction thereof is provided on the connector housing A, and the front end of a conductive metal bracket (not shown) fixed to a conductive attaching member is inserted into the engaging hole 5 and locked by a locking projection 6 (FIG. 1) provided on an inner wall surface of the engaging hole 5.

Figure 6:
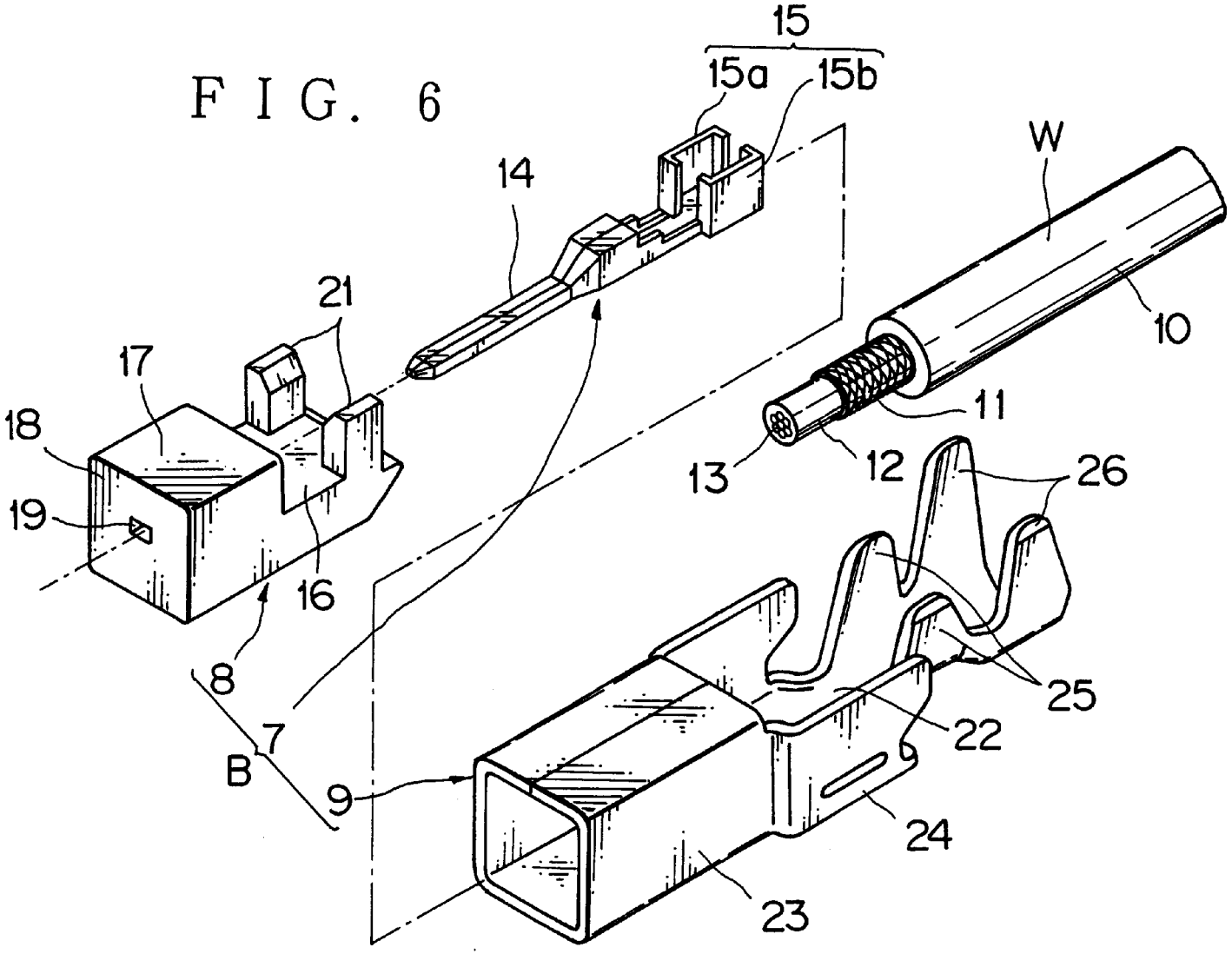
FIG. 6 is an exploded perspective view of the shielded terminal and the shielded wire.

As shown in FIG. 6, the shielded terminal B is made up of an inner terminal 7, an insulating member 8 to cover the inner terminal 7, and an outer terminal 9 to receive the insulating member 8.

A shielding mesh 11 of the shielded wire W is exposed by removing a front end portion of an outer cover 10 for being connected to the shielded terminal B, and further, the front end of the shielding mesh 11 is removed to expose an inner cover 12 covering a core wire 13.

The inner terminal 7 is provided with a male electric contactor 14 and a core wire connecting portion 15 with core wire pressure-welding portions 15*a*,15*b* at the front and rear ends, respectively, also as shown in FIG. 6.

The electric contactor 14 is electrically connected to a female terminal in the mating male connector housing on coupling of the connector housing A thereto.

The inner cover 12 is inserted into the core wire connecting portion 15, and the core wire 13 is pressure-welded to the core wire pressure-welding portions 15*a*,15*b*.

The insulating member 8 insulating the inner terminal 7 is provided with an insulating support-board 16 and a supporting duct 17 with a front wall 18 having a through hole 19 in the center thereof, and insulation ribs 21 are provided at the rear end of the insulating support-board 16.

The front end of the electric contactor 14 having been inserted into the supporting duct 17 projects from the through hole 19.

On the outer terminal 9 shown in FIG. 6, a supporting-duct accommodating portion 23 in a tubular-shape is formed at the front end of a base plate 22, an expanding portion 24 expanding outwardly from both side-walls of the supporting-duct accommodating portion 23 is provided in the rear of the supporting-duct accommodating portion 23, and shield holding pieces 25 and outer cover holding pieces 26 both projecting upwardly from both sides of the base plate 22 are provided at the rear end of the base plate 22.

The supporting duct 17 of the insulating member 8 is accommodated in the supporting-duct accommodating portion 23, and a locking piece 22*a* (FIG. 4) projecting inside the supporting-duct accommodating portion 23 engages an engaging recess 17*a* (FIG. 1) on the supporting duct 17.

The expanding portion 24 gets in contact with a metal duct 32 provided in the terminal accommodating chamber 3, and the shield holding pieces 25 and the outer cover holding pieces 26 hold the shielding mesh 11 and the outer cover 10, respectively, of the shielded wire W by pressure-bending work.

The outer terminal 9 is effectively mass-produced by such a manufacturing method mentioned below.

Figure 5:
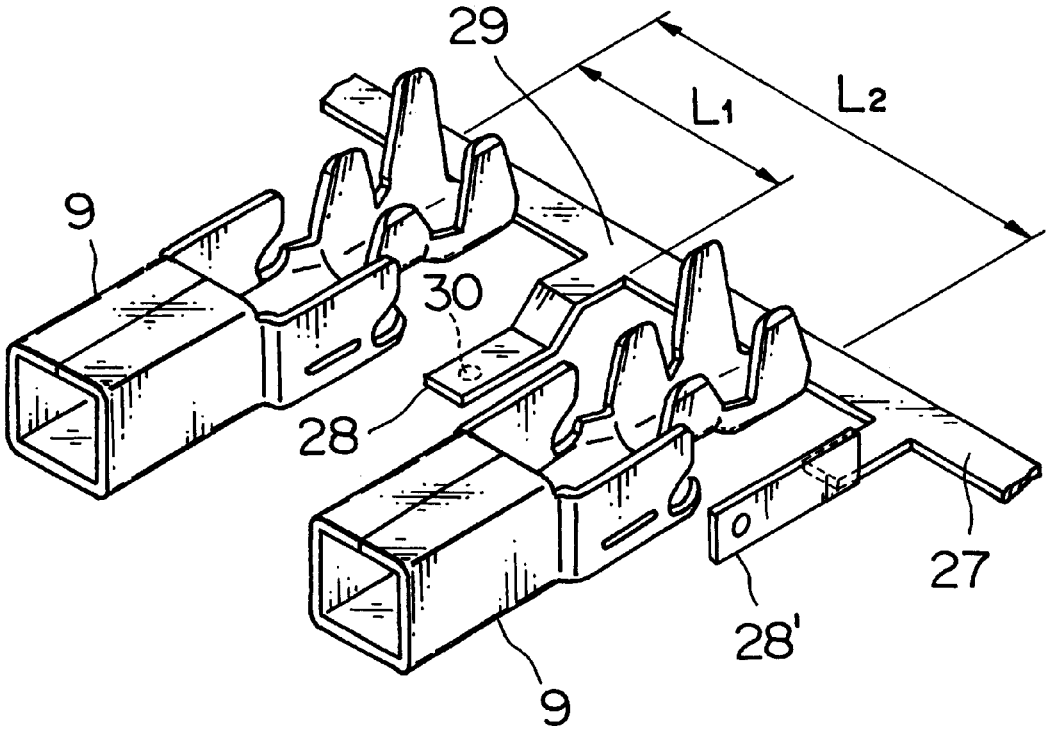
FIG. 5 is a perspective view showing formation of the outer terminal and the grounding plate.

Specifically, a banded sheet metal is fed on a press, a number of pieces in a shape of the outer terminal 9 being developed flatly and in a state of connection to a serial band portion 27 extending in a longitudinal direction of the banded sheet metal are punched, and the pieces are bent to form a shape of the outer terminal 9 shown in FIG. 5 in a next pressing process. Conventionally, though the pieces of the outer terminal 9 have been cut off from the serial band portion 27, the outer terminals 9 are not cut off from the serial band portion 27 in the present invention.

In the present invention, a grounding plate 28 connected to the outer terminal 9 is provided, and when the conductive metal bracket fixed to the conductive attaching member engages the connector housing A, the grounding plate 28 directly comes into pressure-contact with the metal bracket to thereby make electrical connection.

As shown in FIG. 5, the grounding plate 28 is disposed near and parallel to the outer terminal 9 and the rear end of the grounding plate 28 is integrally connected to the rear end of the outer terminal 9 through a connecting portion 29 being perpendicular to the grounding plate 28. The connecting portion 29 is formed by cutting the serial band portion 27.

Figure 4:
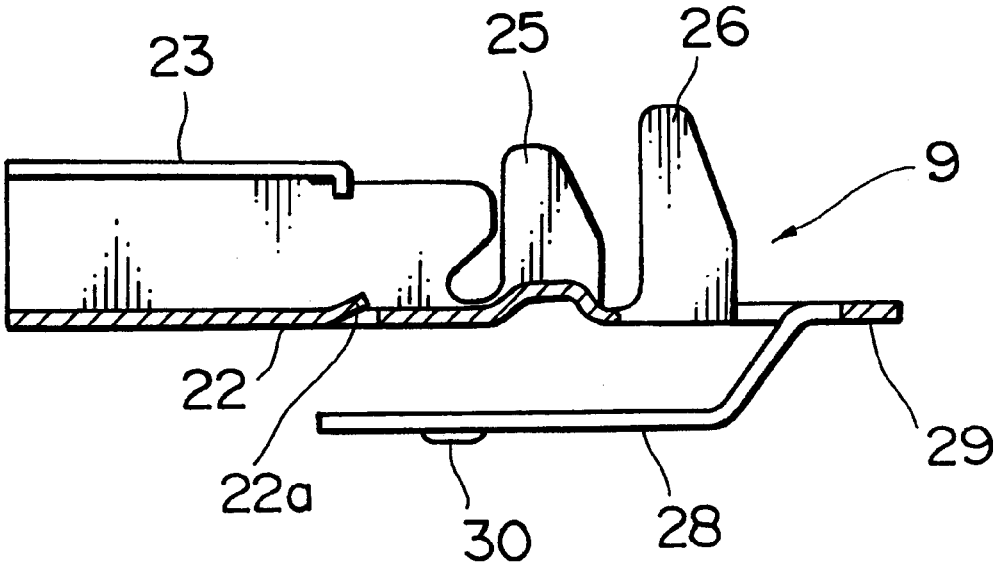
FIG. 4 is a sectional view of the outer terminal formed integrally with the grounding plate.

Since the engaging hole 5 for receiving the conductive metal bracket located under the terminal accommodating chambers 3, an intermediate portion of the grounding plate 28 is bent as shown in FIG. 4 to position the end portion of the grounding plate 28 into the engaging hole 5.

For downsizing the connector housing A, an engaging hole 5 provided between a pair of terminal accommodating chambers 3 and a grounding plate 28' shown in FIG. 5 both having a vertically long cross-section may be applied.

As shown in FIG. 4, a projection 30 is provided at the end of the grounding plate 28 for keeping contact-pressure between the grounding plate 28 and the metal bracket.

The projection 30 can be formed by pressing in the above-mentioned manufacturing process of the outer terminal 9.

The connecting portion 29 is formed with a length of L2 with the outer terminals 9 on both sides of the grounding plate 28 in case two (2) terminal accommodating chambers 3 are provided in the connector housing A or formed with a length of L1 with one outer terminal 9 and one grounding plate 28 adjacent thereto in case one (1) chamber 3 is provided in the connector housing A, by cutting the serial band portion 27.

As for insertion of the shielded terminal B, when the shielded terminal B connected to the shielded wire W is inserted into the terminal accommodating chamber 3, the shielded terminal B is locked by a lance 31 (FIG. 1), provided in the terminal accommodating chamber 3, engaging an upper part of the outer terminal 9 of the shielded terminal B. At the same time, the front end of the grounding plate 28 is inserted into the engaging hole 5.

Another terminal B' connected to another electric wire W' is inserted into the terminal accommodating chamber 4 and locked.

Next, when the front end of the conductive metal bracket fixed to the conductive attaching member is inserted into the engaging hole 5 from the front side of the connector housing A, the metal bracket engages the locking projection 6 (FIG. 1) and is locked within the connector housing A, while the metal bracket gets in pressure-contact with the projection 30 of the grounding plate 28. Consequently, the shield of the shielded terminal B is grounded through the grounding plate 28 and the metal bracket.

When the mating male connector housing is inserted into the hood 1, a shielded terminal in the male connector housing is electrically connected to the shielded terminal B.

What is claimed is:

1. A shielded connector comprising:

a connector housing having a terminal accommodating chamber and an engaging hole along a side of the connector housing to make a grounding connection therein;

a shielded terminal, to be accommodated in the terminal accommodating chamber, having an inner terminal, an insulating member covering the inner terminal, and an outer terminal covering the insulating member; and a grounding plate extending from a base plate of said outer terminal and inserted into said engaging hole upon insertion of the outer terminal into said terminal accommodating chamber, so as to ground the outer terminal;

whereby the structure of the connector housing is simplified and grounding reliability is enhanced.

2. The shielded connector according to claim 1, further comprising a connecting portion which integrally connects the outer terminal and the grounding plate.

3. The shielded connector according to claim 1, further comprising a projection provided on the grounding plate so as to secure electrical contact and grounding through said grounding plate.

4. The shielded connector according to claim 2, further comprising a projection provided on the grounding plate so as to secure electrical contact and grounding through said grounding plate.

5. The shielded connector according to claim 2, wherein the connecting portion has a length corresponding to number of the outer terminal and is arranged on a wire connecting side of the outer terminal.

6. The shielded connector according to claim 4, wherein the connecting portion has a length corresponding to number of the outer terminal and is arranged on a wire connecting side of the outer terminal.

* * * * *